United States Patent [19]

Atzinger

[11] 4,452,337

[45] Jun. 5, 1984

[54] SECTIONAL SCAFFOLDING RAISING APPARATUS

[76] Inventor: Louis E. Atzinger, 2608 Foxy Poise Rd., Louisville, Ky. 40220

[21] Appl. No.: 429,759

[22] Filed: Sep. 30, 1982

[51] Int. Cl.[3] ..... B66C 11/04; E04G 0/1

[52] U.S. Cl. ..... 182/178; 182/179; 182/121; 52/637

[58] Field of Search ..... 182/178, 179, 129, 121; 52/637, 638

[56] References Cited

U.S. PATENT DOCUMENTS

| | | | |
|---|---|---|---|
| 334,237 | 1/1886 | Ketchum | 182/206 |
| 342,924 | 6/1886 | Nonderborg | 182/206 |
| 926,925 | 7/1909 | Carmony | 52/637 |
| 1,539,109 | 5/1925 | Brandt | 52/123.1 |
| 2,308,832 | 1/1943 | Ronoy | 182/178 |
| 2,377,758 | 6/1945 | Coher | 52/123.1 |
| 2,435,171 | 1/1948 | Weisz | 52/637 |
| 2,530,452 | 11/1950 | Duffey | 182/121 |
| 2,857,026 | 10/1958 | Jones | 52/637 |
| 2,890,082 | 6/1959 | McDaniel | 182/63 |
| 3,504,461 | 4/1970 | Copeland | 52/123.1 |

FOREIGN PATENT DOCUMENTS

| | | | |
|---|---|---|---|
| 2348067 | 10/1975 | Fed. Rep. of Germany | 182/129 |
| 1329419 | 12/1963 | France | 182/129 |
| 96611 | 8/1939 | Sweden | 52/637 |

*Primary Examiner*—Ramon S. Britts
*Assistant Examiner*—Alvin Chin-Shue
*Attorney, Agent, or Firm*—Richard L. Caslin

[57] ABSTRACT

Sectional scaffolding assemblies are widely used by craftsmen in the construction industry. Multiple levels of interlocking scaffolds are employed to reach high locations. The present invention is shown as a vertical hoisting pole or mast that is furnished with vertically-spaced clamp members located adjacent the lower end of the mast for coupling the mast to both an intermediate upright on an end frame of the scaffolding as well as to vertically-spaced rungs on the end frame. A pulley assembly is suspended from the top of the mast, and it includes a long rope acting with the pulley. One end of the rope is fitted with a loop that is adapted to be lowered over a top corner pin of the end frame. This loop carries an elongated push rod that has a hook formed on the free end thereof. This push rod may be used for lifting the loop off of the corner pin so as to easily disconnect the rope from the end frame, and the hook end of the push rod may serve for lifting the platform or deck from one level of scaffold to another. A main objective of using this hoisting mast is to shift the load of raising the scaffolding elements to the person working at ground level so that the person working at the top level will have less work to do and will be in a safer operating position.

8 Claims, 7 Drawing Figures

SECTIONAL SCAFFOLDING RAISING APPARATUS

BACKGROUND OF THE INVENTION

1. Field of the Invention

This invention relates to tubular steel sectional scaffolding which are widely used in the construction industry to serve as work platforms of varying heights for use by bricklayers, painters, carpenters, electricians and maintenance workers. The present invention relates to hoisting apparatus which is assembled to an end frame of the scaffold for hoisting sections of the next level of scaffold for assembly to the existing scaffold.

2. Description of the Prior Art

At the present time, there is no known hoisting equipment available for use in raising sectional scaffolding of the standard type used by craftsmen in the construction industry. The way that it is done today is that one worker remains on the ground, while a second worker is positioned in the top scaffold with a rope that is lowered to the ground so the ground worker may attach the end of the rope to a scaffold end frame or cross brace, so that the top worker pulls on the rope for raising the sections for assembly as the next level of scaffold. Very little work is done by the ground worker, and most of the heavy work is done by the top worker, who is standing on a top platform on top of the existing scaffold without any rails or supports for safety protection. The top worker may lose his balance and fall over the side, and the ground worker is helpless to give the top worker any assistance.

An early patent is the Brandt U.S. Pat. No. 1,539,109 which discloses an errecting crane and gin pull for use in erecting oil derricks. The erecting crane comprises a pair of generally vertical corner pipes, each provided with a pair of vertically-spaced arms having depending pins for pivotally engaging a pair of lugs of adjacent sleeve couplings on the lower sections of the derrick. The upper ends of the two pipes support a horizontal arm that carries a sheave or pulley and a lifting and lowering rope. This patent appears to be limited to use with derricks where the crane has supporting pipes that are mounted at the corner posts of the derrick.

The Cohen U.S. Pat. No. 2,377,758 discloses a boom or gib that is supported at the top of a standing scaffold for pivotal movement by means of a cable and winding drum that is positioned near ground level. The pivoted boom or gib is capable of being lowered for attachment to a preassembled scaffold at ground level, and then raising this entire preassembly up until it is attached to the existing standing scaffold. In other words, this patent bodily raises an entire new section of scaffold and connects it with a standing scaffold, rather than performing the assembly in sections.

The Jones U.S. Pat. No. 2,857,026 relates to means for erecting elevator towers. Such a tower is of the type that is used in handling building materials during the construction of a high-rise building. This elevator tower is not a simple scaffolding, but it is a double tower having two end frames and an intermediate frame which are reinforced by side braces. This patent has section hoist apparatus comprising a superstructure of two vertical posts, one attached to an end frame and the second attached to an intermediate frame. There is also a pivotally-mounted strut and a horizontal boom that is formed as an I-beam for accommodating a block and tackle apparatus. There is also a windlass located near ground level for use with a cable system for raising the sections of scaffolding.

The McDaniel et al U.S. Pat. No. 2,890,082 relates to tubular steel scaffolding which is provided with a hoisting apparatus for raising and lowering a lift platform for use in transporting various building materials. In other words, this hoisting apparatus is not for erecting the scaffolding itself, but merely to serve as an elevator means for raising building materials. There are two upper pulleys and two lower pulleys and a cable system that is tied into a hoisting unit near ground level.

The Copeland et al U.S. Pat. No. 3,504,461 relates to scaffold erecting equipment, but it is not a manual assembly apparatus, but rather it is a mobile unit of the forklift type having a vertically-extending structure forming a guide way for a carriage, together with power means for elevating and lowering the same. In other words, this Copeland patent relates to external power-operated means in complete modular sections, one on top of the other.

OBJECTS OF THE PRESENT INVENTION

The principal object of the present invention is to provide a portable, vertical hoisting pole or mast for use with a sectional scaffolding assembly so that most of the lifting responsibility will be carried by a person at ground level using a rope, while a person at the top of the scaffolding will merely serve to connect the rising element of scaffold to the existing lower scaffold; thereby making it safer for the top worker and better distributing the working responsibilities between the ground worker and the top worker.

A further object of the present invention is to provide a portable hoisting mast of the class described with a long rope that is fashioned with a loop for easy connection and disconnection with the section of scaffold, where the loop is provided with an elongated push rod for ease in disconnecting the loop, as well as serving as a grappling means for use in raising the platform or deck of the scaffolding.

A still further object of the present invention is to provide a portable hoisting mast of the class described with a pair of vertically-spaced clamp members for ease in coupling the mast to an intermediate upright of an end frame, as well as locking the mast to a pair of vertically-spaced rungs of the end frame.

SUMMARY OF THE INVENTION

The present invention provides a portable, vertical hoisting pole or mast having vertically-spaced clamp members for quick coupling of the mast to an intermediate upright of an end frame of a sectional scaffold where the clamp members engage the upright as well as several vertically-spaced rungs of the end frame. The portable mast is provided with a pulley assembly suspended from the top end of the mast and including a long rope acting with the pulley. One end of the rope is fitted with a loop for easy engagement and disengagement of the rope from a section of the scaffold. The loop carries an elongated push rod which has a hook member on the free end thereof.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENTS

Figure 1:
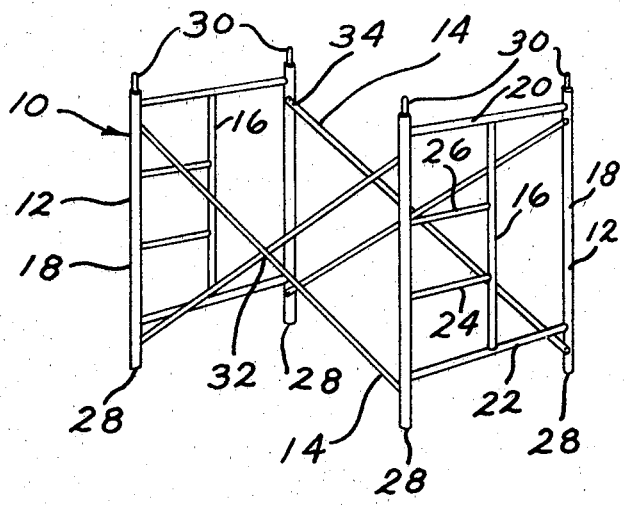
FIG. 1 is a perspective view of a standard sectional scaffold formed mainly of tubular steel and having a pair of end frames that are held together by a pair of cross braces. This particular type of standard scaffold has an end frame with an intermediate upright and horizontal rungs of a ladder formed at one side of the upright. These standard scaffolds are adapted to be stacked vertically, one upon another, in multiple levels for gaining access to hard-to-reach places.

Turning now to a consideration of the drawings, and in particular to the perspective view of FIG. 1, there is shown a standard sectional scaffold 10 that is formed of a pair of end frames 12 that are joined together by a pair of cross braces 14. There are other standard designs of scaffolds that are widely used today, but this design 10 is probably the most widely used. Other types of scaffolds have end frames that are walk-thru frames, and then there is a ladder frame. However, the present invention is particularly adapted for use with the standard scaffold 10 of FIG. 1, where the end frame 12 has an intermediate upright 16. Each end frame 12 is of similar design, and each cross brace 14 is of similar design, so that only one of each will be described in detail. These end frames 12 are sometimes called by the users as a "buck" which is defined by the dictionary as "a supporting rack or frame." Each end frame or buck is formed of tubular steel construction having two vertical side posts 18, a top horizontal rail 20, and a bottom horizontal rail 22. The intermediate upright 16 is joined at its ends to the top rail 20 and the bottom rail 22. A pair of vertically-spaced ladder rungs 24 and 26 are located at one side of the intermediate upright 16 and supported between that upright and the nearest vertical side post 18. The bottom end 28 of each vertical side post 18 is formed as a hollow socket, while the top end 30 of each vertical side post 18 is formed as a vertical coupling pin which is capable of sliding into the hollow socket 28 of the next highest scaffold 10 or end frame or buck 12 which is to be supported by a lower scaffold.

The cross braces 14 are generally of angular or channel shape in transverse cross section, rather than of tubular construction as are the end frames 12 for joining the two members together, and each end 34 of the cross brace is provided with a quick-connect for joining the cross brace to the side of a vertical side post 18. Since all of the above are of a standard scaffold construction that is widely used on the market, and has been for many years, it is felt unnecessary to show all of the specific details of construction, since it does not form part of the present invention.

Figure 4:
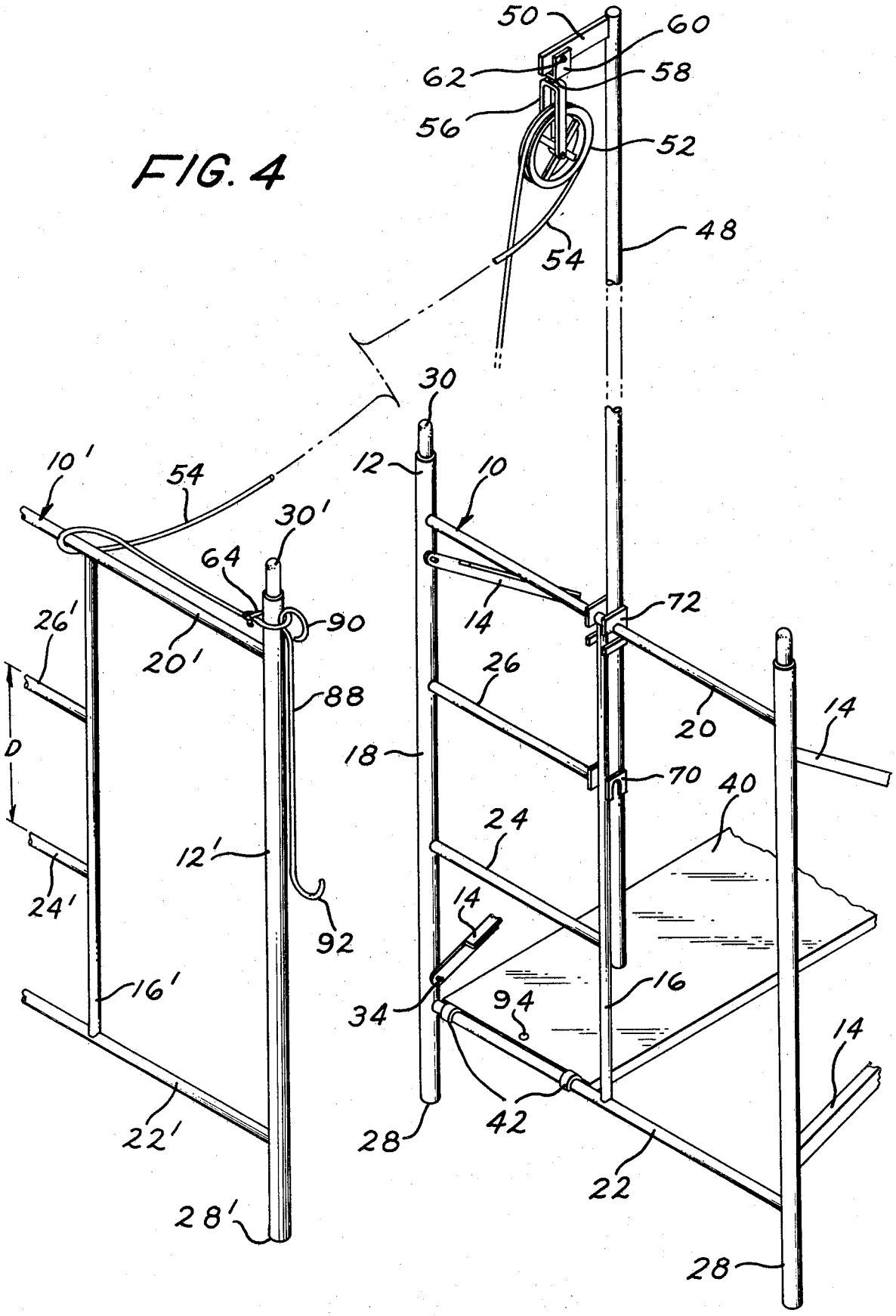
FIG. 4 is a fragmentary, perspective view, on an enlarged scale, of one end of a standard scaffold showing the portable, vertical hoisting mast of the present invention assembled to the intermediate upright of the end frame of the scaffold, and also showing a fragment of a second end frame which is at ground level and has the rope of the pulley assembly of the mast connected to the upper rail of the end of the end frame and with a loop on the rope fitted down onto a top corner pin of the end frame, as well as showing a push rod hanging loose from the end loop of the rope, where the free end of the push rod has a hook member formed thereon. Also shown with the scaffold is a platform or deck that is suspended between the pair of parallel end frames for the support of a worker.

Turning to the fragmentary, perspective view of FIG. 4 of a standard sectional scaffold 10, there is shown at the bottom a platform or deck 40, which may be of plywood or open metal grillwork construction, which is fastened to a channel frame (not shown) that is fitted with a pair of down-turned hook members 42 which are designed to engage either the top or bottom rails 20 and 22 respectively, or the ladder rungs 24 or 26. This particular platform 40 is designed to be half the width of the end frame or buck 12. It should be understood that other types of platforms or decks could be employed to be suspended between the pair of end frames 12 in order to form a supporting floor for use by a workman.

Before the discovery of the present invention, the state of the art of erecting sectional scaffolding has used a rather primitive method of raising the various sections to the higher levels when building a tall scaffolding assembly. Usually, there was one worker who stayed on the ground, and a top worker would stand on the platform 40 that would be positioned on the top horizontal rail 20, so that the top worker would not have any supporting rails around him while he was working to raise additional sections of scaffolding. A simple rope would be dropped by the top worker to the ground worker, and this ground worker would tie one end of the rope to a section of scaffold and the top worker would pull up the section hand-over-hand. The ground worker has an easy job, while the top worker has both a hard job and an unsafe job at the top of the existing scaffold.

Figure 2:
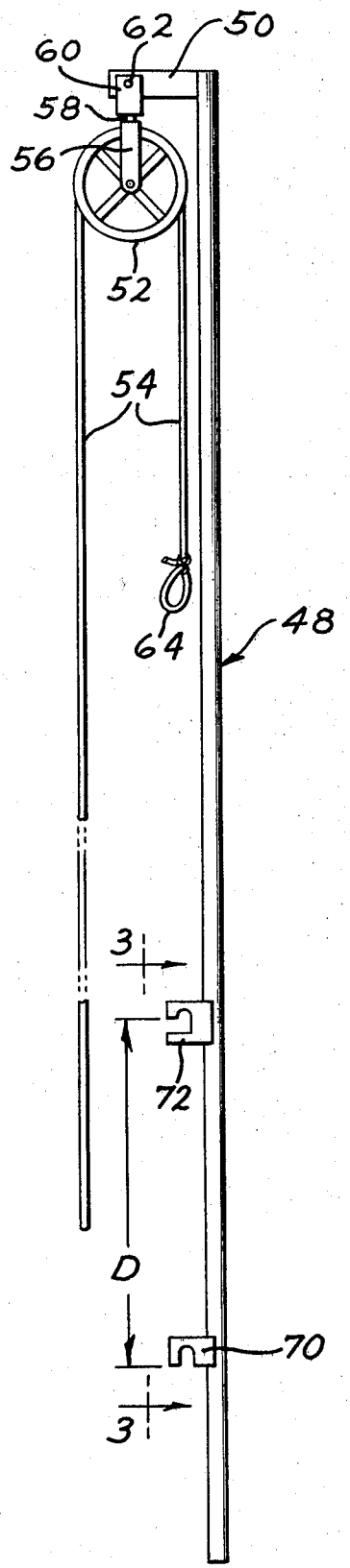
FIG. 2 is a side elevational view, on a larger scale, of a portable, vertical hoisting mast, according to the present invention, provided with a pulley assembly suspended at the top of the mast and a long rope for use with the pulley. Also shown on the mast is a pair of vertically-spaced clamp members near the lower end thereof for quick-coupling of the mast to an end frame of the scaffold.

The present invention is best shown in FIG. 2, and it comprises a portable, vertical hoisting pole or mast 48 that is preferably formed of lightweight, aluminum, electrical conduit 48 of about 10 feet in length. At the top of the mast 48 is mounted a bracket 50 from which is suspended a pulley 52 that supports a long rope 54. The pulley is pivoted within a yoke 56 that in turn has a vertical pivot 58 with respect to a connecting bracket 60 that is joined to the first bracket 50 by means of a bolt 62. Notice that one end of the rope 54 is fitted with a loop 64, which is preferably formed as an eye-splice so that it doesn't tend to close when a pulling force is exerted on the rope.

Figure 3:
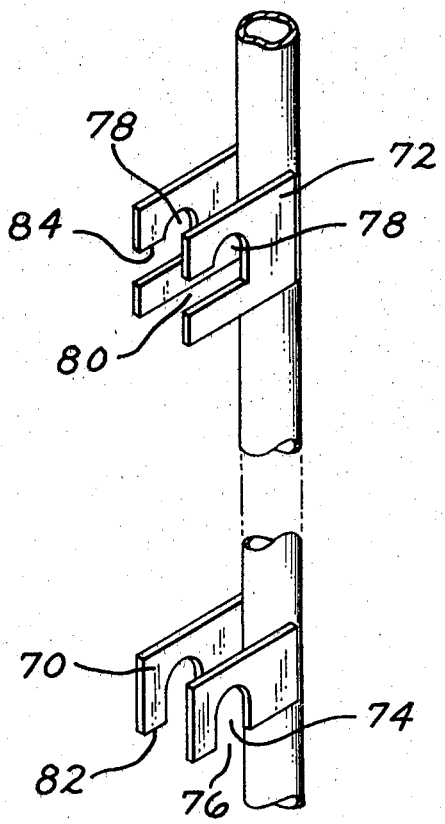
FIG. 3 is a fragmentary, perspective view, on an enlarged scale, taken on the line 3—3 of FIG. 2, of the lower end of the vertical mast of FIG. 2 showing the nature of the two vertically-spaced clamp members, where each clamp member comprises a pair of similar parallel plates that serve to straddle the intermediate upright of the end frame of the scaffold.

A novel means has been employed for locking the portable mast 48 to the end frame or buck 12 of the scaffold 10. This can best be understood with reference to FIGS. 2, 3 and 4. At the lower end of the portable mast 48 there are formed two vertically-spaced clamp members 70 and 72 which are adapted to engage at least two of either the ladder rungs 24 and 26, as well as the top horizontal rail 20 or the bottom horizontal rail 22. Each clamp member 70 and 72 is unique and dissimilar from the other clamp member. However, these clamp members have one thing in common, in that they each comprise a pair of similar parallel plates which are welded to the side of the portable mast 48, so that these parallel plates are able to straddle the intermediate upright 16, as is best seen in FIG. 4. Each parallel plate of the lower clamp member 70 is provided with a vertical slot 74 that is open at the bottom edge 76 of the plate, while each parallel plate of the upper clamp member 72 is fitted with a vertical slot 78 that is open at the vertical, free side edge 80 of each plate. There is generally a uniform distance between the top edge of the top rail 20 and the top edge of the ladder rung 26. The same is true of the top edge of the rung 26 and the next lower rung 24. In a similar manner, the same is true of the distance from the top surface of the lower rung 24 and the top surface of the bottom rail 22. This uniform distance will be called "D", and this distance determines the distance between the horizontal bottom edge 82 of each parallel plate of the lower clamp member 70 and the top horizontal edge 84 of the horizontal slot that joins the vertical slot 78 with the open edge 80 at the side of each of the parallel plates of the top clamp member 72. This distance "D" is shown diagrammatically in FIG. 2 of the drawings.

In order to assemble the mast 48 to the end frame 12 shown in FIG. 4, the mast is brought toward the intermediate upright 16 from the inside of the end frame so that the parallel plates of both clamp members 70 and 72 will tend to straddle this upright 16. The lower clamp member 70 is positioned just above the top edge of the upper ladder rung 26, and the upper clamp member 72 is positioned with the top horizontal rail 20 moving into the open end 80 of the slot in this upper clamp member until the rail 20 reaches the vertical slot 78. Then the mast 48 is allowed to lower so that the rung 26 will slip into the vertical slot 74 of one of the parallel plates of the lower clamp member. At the same time, the top rail 20 will move up into the vertical slot 78 of the top clamp member 72, and thus the mast 48 will be locked in place on the top rail 20 and the top rung 26. In order to disengage the mast 48 from the end frame 12, a reverse action is followed; namely, raising the mast slightly, and then sliding the mast away from the end frame so that the rail 20 will exit the open edge 80 of the top clamp member 72.

Figure 5:
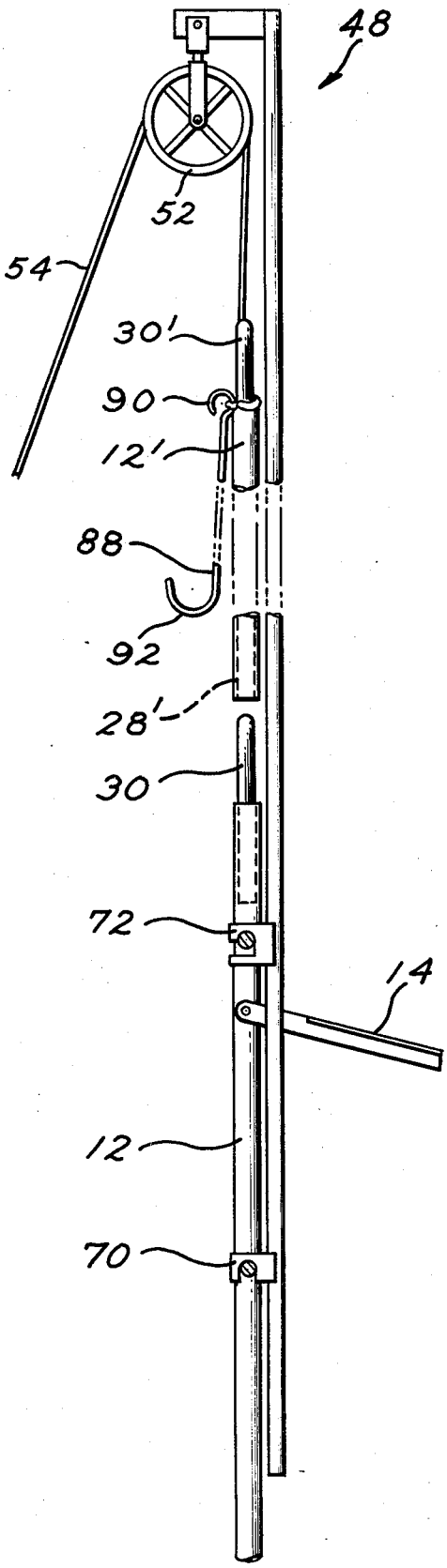
FIG. 5 is a fragmentary, side elevational view of the scaffold of FIG. 4 after the hoisting mast has been used for raising the second end frame into a vertical position directly overlying a first end frame in preparation for lowering the top end frame into interlocking engagement with the lower end frame.

The preferred method of using the present invention can best be understood with relation to the fragmentary, perspective view of FIG. 4. Consider that the scaffold 10 is fully assembled, and it is desired to add a second scaffold 10' above the first. This second scaffold 10' is a mirror-image of the first scaffold 10, in that they have mating interlocking and interchangeable parts or sections. Similar elements of both will be given the same reference numerals for ease in understanding this invention. The workers will install the platform 40 on the bottom horizontal rail 22 so that the top worker will be standing on this platform 40. It should be understood that while this scaffold 10 is shown at ground level, it could just as well be 30 feet in the air. It should be considered that this scaffold 10 in FIG. 4 is at a high level, and there is a desire to raise or erect an additional scaffold 10' above scaffold 10. Scaffold 10' has an end frame 12' with a top horizontal rail 20' and an intermediate upright 16'. Notice particularly how the rope 54 has been attached by the ground worker to the end frame 12'. The end of the rope 54 that has the loop 64 is first brought under the top horizontal rail 20' on the side of the intermediate upright 16' that is opposite the top right corner coupling pin 30'. Then the loop 64 is brought over to the corner of the end frame and lowered over this coupling pin 30', as is clearly seen in FIG. 4. In other words, the rope 54 is not tied with a knot to the end frame 12', but it is loosely attached to the end frame, so that by pulling on the rope, the end frame will rise toward the pulley 52 until this end frame 12' reaches a position above the first end frame 12, as is best seen in FIG. 5. Here in FIG. 5, the top end frame 12' is shown aligned above the lower end frame 12 so that the socket 28 at the bottom of the vertical side post of the end frame is about to descend upon the vertical coupling pin 30 that is at the top of the vertical side post 18. It is at this moment the top worker, standing on the platform 40, will grasp the lower ends of the vertical side post 18 and help to guide them onto the coupling pins 30. Notice at this moment that the top worker is safely protected inside of the scaffold 10 by the two end frames 12, 12 and the two cross braces 14, 14. There is no danger that this top worker will lose his balance and fall because he is safely within the scaffold 10 and the end frame 12' being erected is mainly supported by the rope 54, and the top worker need only guide the downward movement of this end frame 12' into mating engagement with the end frame 12. Most of the heavy work of pulling on the rope 54 is done by the ground worker.

Figure 6:
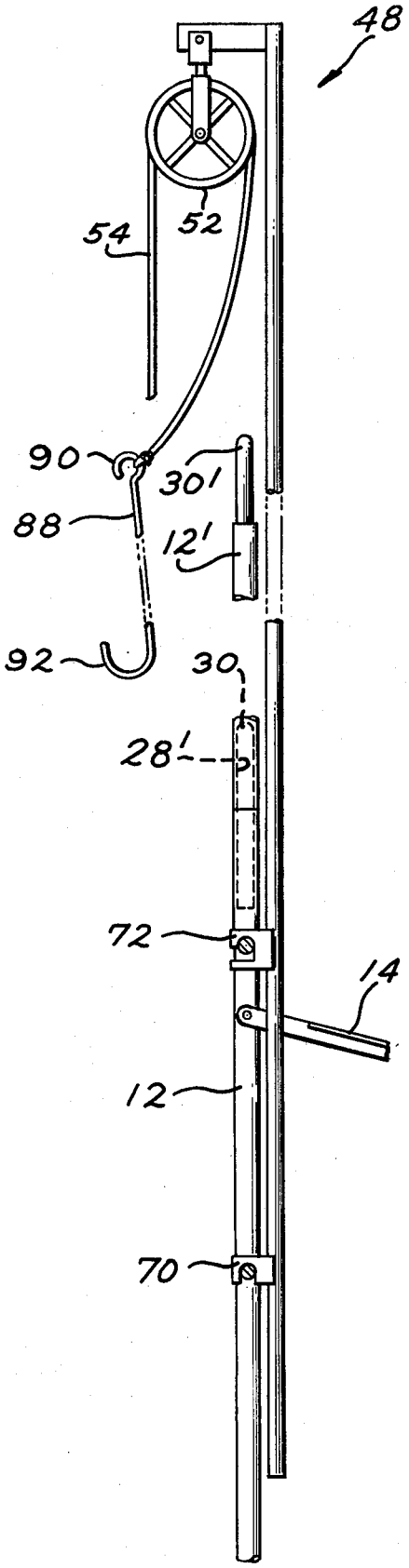
FIG. 6 is a fragmentary, side elevational view, similar to that of FIG. 5, after the upper end frame has been interlocked with the lower end frame, and the loop of the rope has been disconnected from the top corner pin of the upper end frame.

FIG. 6 is a view similar to that of FIG. 5 showing the top end frame 12' lowered into interlocking engagement with the lower end frame 12. Now the top worker must disengage the loop 64 from the vertical coupling pin 30'. The top worker is not able to reach the loop 64 because he is standing on the platform 40 that is at the level of the bottom horizontal rail 22.

The present invention incorporates a push rod 88 that has a ring 90 at its upper end that is engaged in the loop 64, as is best seen in FIG. 4. This push rod 88 is about 40 inches in length, and it has a large hook formation 92 on its other end, which can also serve as a handle for use by the top worker. The top worker may use this push rod to raise the loop 64 above the coupling pin 30' so as to disengage the rope 54 from the side frame 12', as is illustrated in FIGS. 5 and 6 of the drawings. Thus, it is not necessary for the top worker to climb up a portion of this end frame 12' in order to reach the loop 64 with his hand.

The push rod has a second important function to perform; namely, to assist in shifting the position of the platform 40, as will be described with relation to FIGS.

Figure 7:
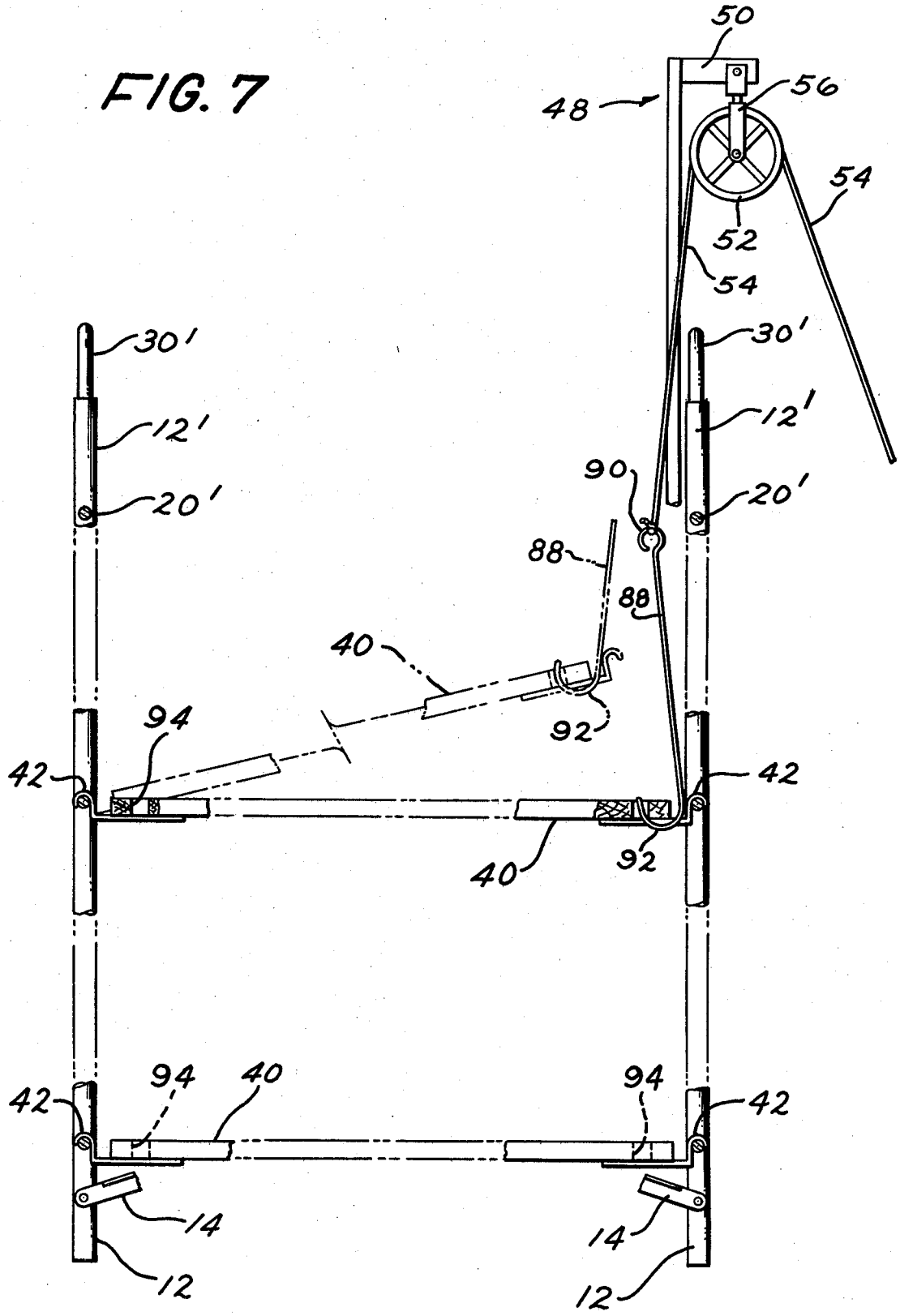
FIG. 7 is a side elevational view of a scaffolding assembly where the distance between the two parallel end frames has been shortened, and where the portable hoisting mast of the present invention is shown assisting in raising one end of the platform or deck of the scaffold from one elevation to a higher elevation, it being understood that the other end of the platform or deck would be raised by an upper worker manually lifting that end.

4 and 7. Notice in FIG. 4 that a small hole 94 is shown in the end of the platform 40 near where the platform stops short of the bottom rail 22. The hook formation 92 of the push rod 88 is capable of engaging under the edge of the platform and to be hooked into the hole 94, as is best seen in FIG. 7. Once the push rod 88 is hooked into one end of the platform 40, the top worker would move to the opposite end of the platform, and, while standing on the end frame 12, would grasp the end of the platform and tend to raise that end of the platform, while the ground worker will be pulling on the rope so as to lift the opposite end by means of the push rod 88 until the platform is raised above a desired new level, and then the top worker would engage the down-turned hook members 42 of the platform with the adjacent rungs 24' or 26' or the adjacent bottom rail 22'. Thus, it is possible for the ground worker to assist in raising the platform 40 while still remaining on the ground, by means of the rope 54 and the push rod 88.

Having described a novel invention of apparatus and method of raising a sectional scaffolding assembly by means of a portable hoisting mast, it will be readily apparent to those skilled in this art that this hoisting mast will also be used to dismantle this scaffolding in a reverse manner, as well as being used to bring up tools and materials for use by the workers while supported above the ground on this scaffolding system. While this invention has been described with particular relation to a standard sectional scaffold 10 having an intermediate upright with ladder rungs at one side of the upright, it will readily be apparent to those skilled in this art that the clamp members 70 and 72 could be modified for conversion of this hoisting mast to other types of end frames or bucks without departing from the scope of the present invention. While a half platform 40 has been shown for use as a deck by the upper workers, it will readily be apparent that other designs of platforms could be used in place of this one without departing from the scope of the present invention.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. In a sectional scaffolding assembly comprising multiple levels of interlocking scaffolds, each scaffold having a pair of end frames supported by a pair of side cross braces, each end frame having top and bottom horizontal rails and an intermediate upright with a plurality of vertically-spaced rungs supported on at least one side thereof, and a platform or deck adapted to be suspended from the rails or rungs of the opposite end frames; the invention comprising:

a. a portable, vertical hoisting pole or mast having vertically-spaced clamp members located adjacent the lower end thereof and adapted for coupling with both the vertically-spaced rungs of an end frame and the intermediate upright;

b. a pulley assembly suspended from the top end of the mast and including a long rope acting with the pulley, one end of the rope being fitted with a loop, where the loop carries an elongated push rod having a hook formed on its free end;

c. where the loop of the rope is adapted to slip over a top corner pin of the end frame to be raised, while the said push rod is adapted to be used for raising the loop of the rope off of the corner pin and thereby disconnecting the rope from the end frame.

2. The subcombination of a portable, vertical hoisting pole or mast that is especially adapted for use with a standard sectional scaffolding assembly having multiple vertical levels of interlocking scaffolds, where each scaffold has a pair of end frames supported by a pair of side cross braces, and each end frame has top and bottom horizontal rails and an intermediate upright with a plurality of vertically-spaced rungs supported on at least one side thereof, and a platform or deck adapted to be suspended from the rails or rungs on the opposite end frames, said pole having vertically-spaced clamp members located adjacent the lower end thereof and being rigidly attached thereto, each clamp member comprising a pair of similar parallel plates, the bottom clamp having a vertical slot in each plate that is open at the bottom edge, while the top clamp has a vertical slot in each plate that is open at the vertical free side end of the plate, whereby the clamp members are capable of serving first of straddling an intermediate upright on the end frame of an assembled sectional scaffold, and are capable of locking with the vertically-spaced rungs of the end frame, and a pulley assembly suspended from the top end of the mast and including a long rope acting with the pulley, the rope being adapted to be attached to elements of a sectional scaffold for raising the sections of scaffolding by pulling on the rope at ground level.

3. The invention of a portable hoisting pole or mast as recited in claim 2, wherein one end of the rope is fitted with a loop that carries an elongated push rod having a hook formed on its free end, where the loop of the rope is adapted to slip over a protuberance of a standard scaffold section to be raised by the rope, while the said push rod is adapted to be used for lifting the loop of the rope off of the protuberance and thereby disconnecting the rope from the section being raised.

4. The invention of a portable hoisting pole or mast as recited in claim 3, wherein the hook formed on the free end of the push rod may serve for joining the rope to standard sections of scaffolding to be raised by the mast.

5. The invention of a portable hoisting pole or mast for use with a sectional scaffolding assembly as recited in claim 1, wherein the rope is adapted to be strung under the top rail of an end frame that is to be raised, and then the loop of the rope is carried over to a top corner pin of the end frame that is on the side of the intermediate upright opposite where the rope loops under the top rail, then the loop of the rope is lowered over the top corner pin, and the push rod hangs loosely from the loop so that the effect is that the rope is generally connected to the end frame to be raised near the top portion of the intermediate upright which is generally at the center of the end frame, the end frame having a socket in each lower corner and a vertical pin in each upper corner whereby a second end frame may be interlocked with a lower end frame by lowering the sockets onto the top vertical pins, it being possible to disconnect the rope from the topmost end frame by raising the push rod so as to lift the loop off of the vertical corner pin so that the rope is no longer joined to the topmost end frame.

6. The invention of a portable hoisting pole or mast for use with a sectional scaffolding assembly as recited in claim 1, wherein the said platform or deck is provided with a hole at each end for receipt of the hook end of the push rod so that the hoisting mast may be used for raising the platform or deck from one end frame to another when a person assists at the opposite end of the platform to manually raise one end while the other end is being raised by the hoisting mast.

7. A method for erecting and dismantling a standard sectional scaffolding assembly comprising multiple vertical levels of interlocking scaffolds, which comprises the steps of:

a. manually erecting the first ground-level scaffold including a portable platform;

b. attaching a portable hoisting mast to one end frame of the ground-level scaffold near the center of the end frame, the hoisting mast having a pulley and long rope suspended from the top thereof;

c. a ground worker loosely attaching one end of the rope to another section of scaffold on the ground, and the ground worker pulls on the other end of the rope for raising that section of scaffold above the ground-level scaffold;

d. a top worker supported on the said platform of the ground-level scaffold for guiding the raised section of scaffold into an interlocking position with the ground-level scaffold;

e. the top worker employing a quick-release remote control means carried by the end of the rope for disengaging the rope from the raised section of scaffold, wherein the said quick-release remote control means is an elongated push rod that is carried by one end of the rope that has a fixed loop for quick-connection of the rope to and from each section of scaffold being erected or dismantled.

8. The method invention as recited in claim 7 wherein the said elongated push rod has a hook formation on its free end for engaging a section of scaffold whereby the ground worker is able to raise one end of the said portable platform by means of the rope and its push rod, while the top worker manually raises the opposite end of the platform.

* * * * *